US006615009B2

(12) United States Patent
Hosoya et al.

(10) Patent No.: US 6,615,009 B2
(45) Date of Patent: Sep. 2, 2003

(54) LIQUID DEVELOPER IMAGE FORMING APPARATUS AND DEVELOPING SYSTEM

(75) Inventors: Masahiro Hosoya, Saitama-Ken (JP); Hideki Nukada, Kanagawa-Ken (JP); Masaki Takahashi, Kanagawa-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/951,514

(22) Filed: Sep. 14, 2001

(65) Prior Publication Data

US 2002/0034402 A1 Mar. 21, 2002

(30) Foreign Application Priority Data

Sep. 18, 2000 (JP) ..... 2000-282515

(51) Int. Cl.[7] ..... G03G 21/16
(52) U.S. Cl. ..... 399/111; 399/107; 399/167
(58) Field of Search ..... 399/107, 108, 399/110, 111, 119, 167, 227, 233, 237, 239, 249, 343, 348, 350, 351, 352, 357, 358

(56) References Cited

U.S. PATENT DOCUMENTS 4,728,983 A 3/1988 Zwadlo et al.
5,570,173 A 10/1996 Nye et al.
5,608,507 A 3/1997 Nguyen
5,708,934 A * 1/1998 Nagase et al. ..... 399/178
6,249,663 B1 * 6/2001 Alzawa et al. ..... 399/167

OTHER PUBLICATIONS

M. Hosoya, et al., Japan Hardcopy 2000, The Annual Conference of the Imaging Society of Japan, pp. 161–164, "Image–On–Image (=IOI) Color Process Using Liquid Toner", Jun. 12, 2000 (with English Abstract).

* cited by examiner

*Primary Examiner*—Hoang Ngo
(74) *Attorney, Agent, or Firm*—Oblon, Spivak, McClelland, Maier & Neustadt, P.C.

(57) ABSTRACT

Image forming apparatus which uses a liquid developer containing toner particles and a solvent to form an image on a rotatable latent image forming unit and transfer the image to a paper receptor. In one embodiment, the image forming apparatus includes a developing unit disposed adjacent to the latent image forming unit and configured to apply the liquid developer to a latent image on the latent image forming unit, a solvent reducing unit disposed adjacent to the developing unit and configured to reduce the solvent content of a developed image formed on the latent image forming unit, a transfer unit facing the latent image forming unit, an inner case including a frame having a opening arranged adjacent to the transfer unit, and an out case housing the inner case. The inner case supports the latent image retaining body, the latent image forming unit, the developing unit, and the solvent reducing unit inside of the frame.

13 Claims, 8 Drawing Sheets

LIQUID DEVELOPER IMAGE FORMING APPARATUS AND DEVELOPING SYSTEM

CROSS-REFERENCE TO RELATED APPLICATIONS

This application claims the benefit of priority from Japanese Patent Application No. 2000-275030, filed on Sep. 18, 2000, the entire contents of which are incorporated herein by reference.

BACKGROUND OF THE INVENTION

1. Field of the Invention

The present invention relates to an image forming apparatus, which forms the image on a substrate using a liquid developer containing toner particles and a solvent. The present invention also relates to a developing system which can be attached to an image forming apparatus and uses the liquid developer.

2. Discussion of the Background

An image forming apparatus using a liquid developer has promising advantages which an image forming apparatus using dry toner does not have. One advantage arises due to the fact that the liquid developer contains a carrier solvent and toner particles, which have an average particle size in the sub-micrometer range, much smaller than size of dry tone particles, whereby it is high image quality is preferably obtained. The liquid developer also decreases the amount of toner particles needed to develop images, while maintaining high image density. Therefore, liquid toners are economical in addition to enabling realization of fine texture printed images. The liquid developer also allows fixing of a developed image onto a final substrate at relatively low temperature and therefore is preferable from the standpoint of energy conservation.

On the other hand, the image forming apparatus using liquid developer has several features which has rendered its use second to the image forming apparatus using dry toner. One such feature is difficulty in handling the carrier solvent of the liquid developer. The solvent usually contains insulating liquid hydrocarbon, such as "Isoper" sold by Exon. However, the solvent may evaporate at room temperature and produce some odor. Therefore, the liquid developer has not typically been used in an office environment, but instead has been applied to special purposes uses, such as large-sized machines for professional use.

The image forming apparatus using the liquid developer has a developing unit and a latent image retaining body. The developing unit usually has a developing roller, which applies the liquid developer onto a surface of the latent image retaining body at a developing region and is supported via sleeve rings to keep a developing gap from the surface of the image retaining body. The developing roller provides the liquid developer to fill the developing gap and also maintains a certain electric potential difference from the surface of the latent image retaining body to develop the latent image by moving the toner particles in the solvent by electrophoresis.

The developing roller and the latent image retaining body push one another via the sleeve rings to maintain the appropriate developing gap. The image forming apparatus usually has four developing units to obtain multi color image and therefore the latent image retaining body receives pressures from four developing units. The four colors are usually yellow, magenta, cyan, and black.

A solvent in the developing image on the latent image retaining body may be removed by a solvent removing unit and the solvent removed image is transferred to an intermediate transfer body, which usually has an elastic surface layer and is pressed against the latent image retaining body at a transfer station. The image on the intermediate transfer body is transferred to a paper, which is caught between the intermediate transfer member and a backup roller.

The intermediate transfer body is pressed at a nip region against the latent image retaining body with high pressure; therefore the latent image retaining body receives the pressure at the nip region. When the latent image retaining body is a drum, its shaft keeps the drum rotating during its operation and receives the high pressure.

SUMMARY OF THE INVENTION

An object of the present invention is to provide an image forming apparatus and an image developing system, which use a liquid developer, and reduce leakage of the solvent or the solvent vapor of the liquid developer, therefore is appropriate for the general use in offices and homes.

In various aspects, embodiments of the present invention provide image forming apparatuses, which form an image on a substrate by using a liquid developer containing toner particles and a solvent.

According to a first aspect, one embodiment of the present invention provides an image forming apparatus, which includes a latent image retaining body including a photosensitive layer, a developing unit disposed adjacent to the latent image forming unit, a solvent reducing unit disposed adjacent to the developing unit, a transfer unit disposed adjacent to the latent image retaining body and the solvent reducing unit, and an inner case comprising a frame and a portion defining an opening of the frame. The developing unit faces the latent image retaining body and is configured to provide the liquid developer on the image retaining body. The solvent reducing unit is disposed adjacent to the developing unit, facing the latent image retaining body, and configured to reduce the solvent of the liquid developer on the latent image retaining body. The inner case supports the latent image retaining body, the developing unit, and the solvent reducing unit inside of the frame, and the portion defining the opening is arranged adjacent to the transfer unit.

In a third aspect, one embodiment of the present invention provides an image forming apparatus, which includes rotatable latent image retaining body, a developing unit arranged adjacent to the latent image retaining body, and a transfer surface contacting the latent image retaining body at a transfer station. The developing unit has a developing gap from the latent image retaining body at a developing region, contacts the latent image retaining body at both edges adjacent to the developing region, and is configured to provide a first pressure to the latent image retaining body. The transfer surface is configured to provide a second pressure to the latent image retaining body. The directions of the first and second pressures are antiparallel, and weights of the first and second pressures are substantially equal so as to cancel each other out.

In various aspects, embodiments of the present invention provide developing systems, which can be attached to an image forming apparatus and develop an image by using the liquid developer containing toner particles and a solvent.

In a fourth aspect, the present invention provides a developing system, which comprises a latent image retaining body including a photosensitive layer, a developing unit facing the latent image retaining body, a solvent reducing unit disposed adjacent to the developing unit facing the latent image retaining body, and an inner case including a frame and a portion defining an opening of the frame. The developing unit is configured to apply the liquid developer on the image retaining body. The solvent reducing unit is configured to reduce the solvent of the liquid developer on the latent image retaining body. The inner case supports the latent image retaining body, the latent image forming unit, the developing unit, and the solvent reducing unit inside of the frame. The portion defining the opening is arranged adjacent to the solvent reducing unit.

In a fifth aspect, one embodiment of the present invention provides a developing system, which includes a rotatable latent image retaining drum, a developing unit arranged adjacent to the latent image retaining drum, a transfer body contacting the latent image retaining drum at a transfer station, and a case holding the latent image retaining drum, the developing unit, and the transfer body. The developing unit maintains a developing gap from the latent image retaining drum at a developing region, contacts the latent image retaining drum at both edges adjacent to the developing region, and is configured to provide a first pressure to the latent image retaining drum. The transfer body is configured to provide a second pressure to the latent image retaining drum at the transfer station. Directions of the first and second pressures are antiparallel, and weights of the first and second pressures are substantially equal so as to cancel each other out.

BRIEF DESCRIPTION OF THE DRAWINGS

A more complete appreciation of the invention and many of the attendant advantages thereof is readily obtained as the state becomes better understood by reference to the following detailed description when considered in connection with the accompanying drawings.

DETAILED DESCRIPTION OF THE EMBODIMENTS

In various aspects, the present invention relates to an image forming apparatus using a liquid developer, such as a wet electro-photographic apparatus.

Figure 1:
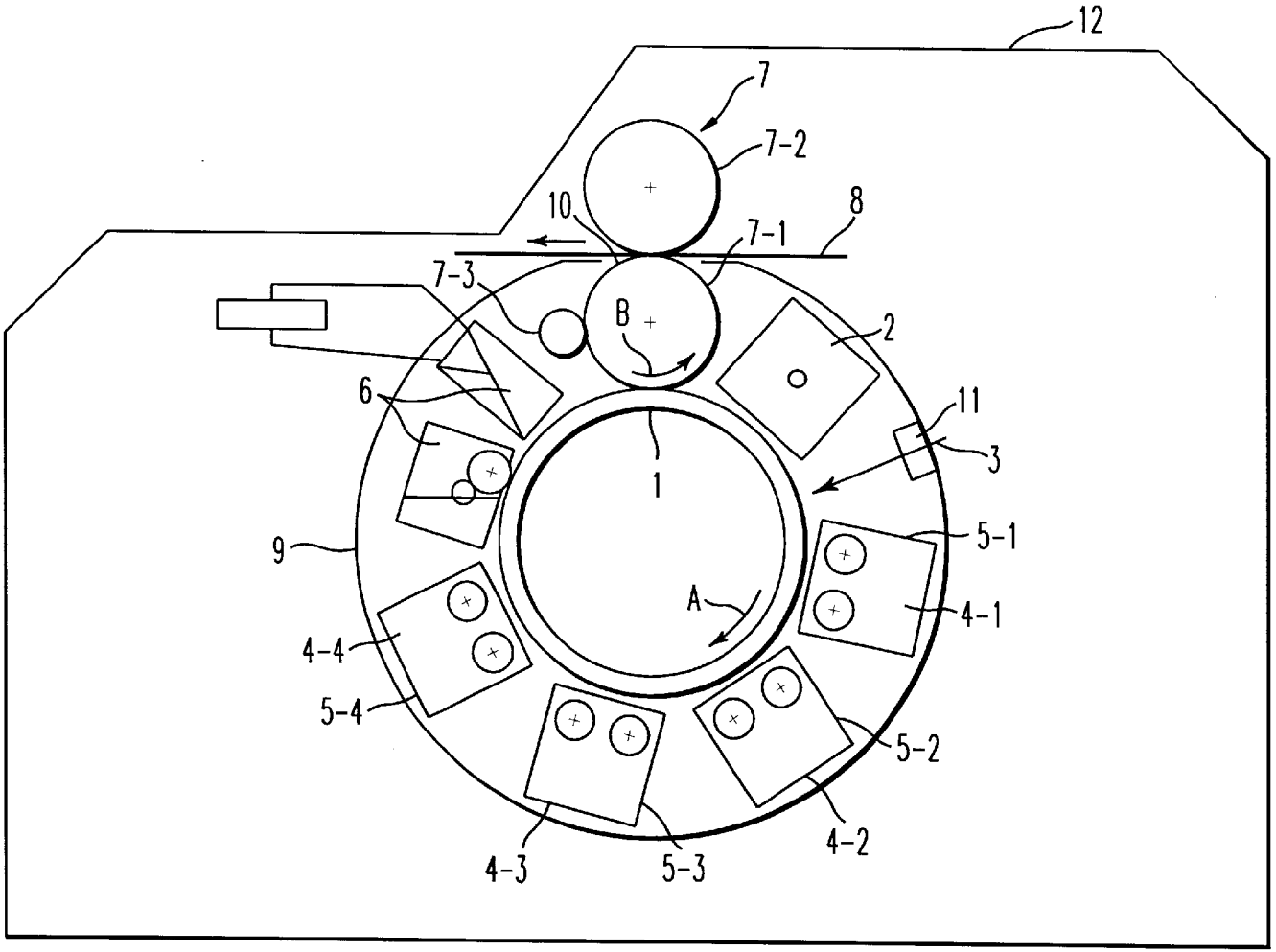
FIG. 1 is a cross-sectional view of an image forming apparatus according to a first embodiment of the present invention.

Referring now to the drawings, where like reference numerals identify the same or corresponding parts throughout the several views, FIG. 1 shows an image forming apparatus according to a first embodiment of the present invention, including a latent image retaining body 1, a charging unit 2, a transparent window 11, which permits a modulated light beam 3 to pass into the inside of a frame of an inner case 9 and onto the latent image retaining body 1, a first developing unit 5-1, a second developing unit 5-2, a third developing unit 5-3, a fourth developing unit 5-4, a solvent reducing unit 6, an intermediate transfer unit 7, the inner case 9, an opening 10, and an outer case 12. The intermediate transfer unit 7 includes an intermediate transfer roller 7-1, a back-up roller 7-2, and a cleaner roller 7-3 which removes a residual image on the intermediate transfer roller 7-1. Each of the four developing units 5-1, 5-2, 5-3, and 5-4 may contain liquid developers 4-1, 4-2, 4-3, and 4-4. Each color of the liquid developers 4-1, 4-2, 4-3, and 4-4 is different from that of the other developers. The color of the liquid developer may be changed based on color image, which is designed in advance. A paper receptor 8 is fed through a second transfer region formed between the intermediate transfer roller 7-1 and the back-up roller 7-2 during an operation of the apparatus.

The inner case 9 is one example of a housing which houses the latent image retaining body 1, the charging unit 2, the four developing units 5-1, 5-2, 5-3, and 5-4, the solvent reducing unit 6, the intermediate transfer roller 7-1, and the cleaner roller 7-3. The transparent window 11 is fixed to the inner case 9. The inner case 9 is supported by the outer case 12 and can be attached to or detached from the outer case 12. Therefore the inner case 9 may be implemented as a cartridge of a developing engine or system. The inner case 9 may alternatively be permanently fixed to the outer case 12.

The latent image retaining body 1 includes a photosensitive layer formed on a drum or a belt, or other equivalent structures well known in the art may be employed.

The charging unit 2 may be a scorotron charging device, or other equivalents well known in the art. The charging unit faces the latent image retaining body 1 at a charging region.

The transparent window 11 for the exposing light beam 3 is fixed to the inner case 9 so that the modulated light beam 3 from a light-exposing unit may pass through the window 11 and draw a latent image on the latent image retaining body 1. The transparent window 11 may be attached to the inner case 9 when the inner case 9 has low permeability for the modulated light beam 3. When the inner case 9 has an appropriate permeability to pass the modulated light beam 3, the transparent window 11 may be eliminated from the image forming apparatus or the developing system.

Each of the four developing units 5-1, 5-2, 5-3, and 5-4 contains respective of the liquid color developers 4-1, 4-2, 4-3, and 4-4. Hereinafter, reference numeral 4 is used as generic symbol of the liquid developer 4-1,4-2,4-3, and 4-4, and reference numeral 5 is used as generic symbol of the developing unit 5-1, 5-2, 5-3, and 5-4.

A filter may be attached to a vent of the outer case 12 to remove any evaporated solvent existing in the outer case 12. The filter absorbs the evaporated solvent, which leaks from the inner case 9 during an operation of the developing engine, and prevents any leakage of the evaporated solvent from the outer case 12 to outside of the outer case 12.

The opening 10 is located at a region including a second transfer station where the intermediate transfer roller 7-1 and the back-up roller 7-2 form a nip. A sealing section may be provided to seal the opening 10, when the inner case 9 is detached from the outer case 12, or image transfer from the intermediate transfer roller 7-1 to the paper 8 is not occurring, so that the vapors from liquid developers 4 may be enclosed inside of the inner case 12.

The solvent reducing unit 6 shown in FIG. 1 is one example. Other structures for reducing the solvent on the body 1, which are known in the art, may be used.

The intermediate transfer unit 7 is one example of a transfer mechanism for transferring the developed image from the latent image retaining body 1 to a final substrate or a recording medium, such as a paper receptor 8. Other equivalent structures, which are known in the art, may be used.

The latent image retaining body 1 in FIG. 1 supported to rotate in a direction indicated by arrow A. The latent image retaining body 1 in FIG. 1 may be a photosensitive drum having an amorphous silicon photosensitive layer or an organic photosensitive layer on a conductive substrate, and is charged uniformly by the charging unit 2, for example a colona charging device, a scorotron charging device, a charging brush, or a charging roller.

The charged region of the latent image retaining body 1 is moved by the rotation of the latent image retaining body 1 to the exposing region opposite the window 8 and is exposed to modulated light beam 3 which passes through the window 11, whereby the latent image is formed on the surface of the latent image retaining body 1.

The latent image retaining region of the latent image retaining body 1 is moved to a developing region, where opposed surfaces of the latent image retaining body 1 and the developing roller 23 face each other, by the rotation of the latent image retaining body 1 and the latent image is developed by the developing unit 5-1, which provides the liquid developer 4-1 to the surface of the latent image retaining body at the developing region.

The solvent reducing unit 6 reduces the solvent content of the developing image on the rotating surface of the latent image retaining body 1 and makes the visible image dryer.

The solvent reduced visible image on the latent image retaining body 1 after passing the unit 6 may consist of solvent of about 30 weight percent or less and solid of about 70 weight percent or more.

The latent image retaining body 1 continuously rotates after the solvent reduction of the first liquid developer and the solvent reduced region is moved to the charging and the exposing regions to be charged and applied with a modulated light beam for the second latent image. The region retaining the second latent image is moved to a second image developing region and the second latent image is developed by the second developing unit 5-2. The region of the latent image retaining body 1 supporting the second developed image is moved to the solvent reducing region and the solvent reducing unit 6 reduces the solvent content. Charging, exposing, developing and solvent removing for respective third and fourth colors may be continued to form the multi-color image on the latent image retaining body 1 in the same manner as the second color.

The solvent removed multi color image on the latent image retaining body 1 is moved by the rotation of the latent image retaining body 1 to a first transfer station where the developed image is transferred from the latent image retaining body 1 to the intermediate transfer roller 7-1.

The transferred image on the intermediate transfer roller 7-1 is transferred to the paper receptor 8 at the second transfer station, and the image on the paper receptor 8 may be fixed by heat, which is applied by the intermediate transfer roller 7-1 and the back-up roller 7-2. The paper receptor 8 is pushed out to outside of the outer case 12 after the image is fixed.

Figure 2:
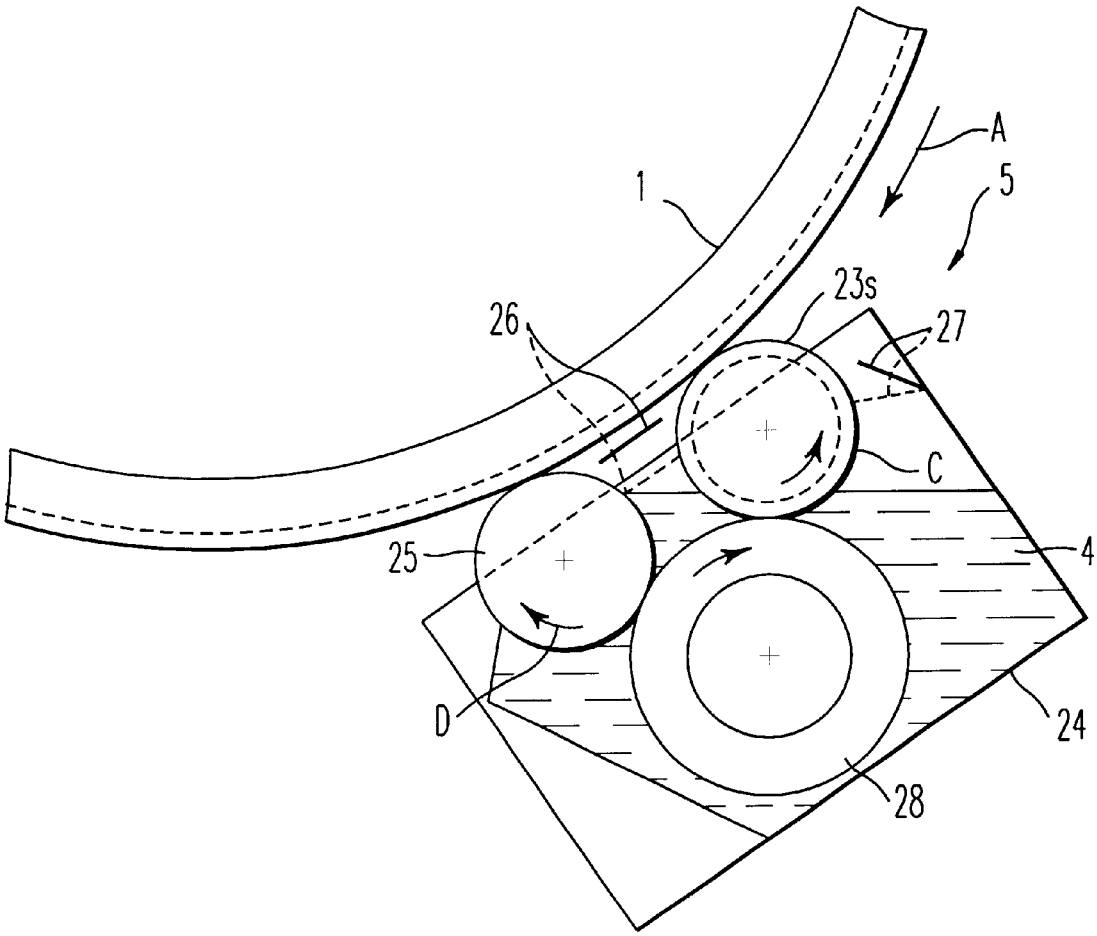
FIG. 2 is a cross-sectional view of a developing unit according to the first embodiment of the present invention.

FIG. 2 shows cross-sectional view of the developing unit 5.

The developing unit 5 shown in FIG. 2 includes a developing roller 23, a liquid developer providing roller 28, and a liquid developer container 24. The developing roller 23 provides the liquid developer 4 to the latent image retaining body 1. The developing roller 23 is disposed adjacent to the latent image retaining body 1 at the developing region and supported by its shaft and rotates in a direction along the arrow shown in FIG. 2. The surface of the developing roller 23 is separated from the surface of the latent image retaining body 1 by a developing gap which may range from about 50 micrometers to about 250 micrometers. The latent image retaining body 1 has sleeve rings 1*s* at opposite edges of a shaft length direction (direction perpendicular to the cross-sectional view shown in FIG. 2).

The opposite edge of body 1 are adjacent to its effective imaging region. The developing roller 23 also has sleeve rings 23*s* at opposite edges. The sleeve rings 1*s* and 23*s* contact and press one another so the developing gap is provided at the developing region. The effective imaging region of the latent image retaining body 1 is a region which undergoes charging, exposing, developing, and solvent reducing and supports the image to be transferred to the intermediate transfer roller 7-1.

The liquid developer providing roller 28 is one example of how to provide the liquid developer 4 to the developing roller 23. The liquid developer providing roller 28 may be pressed against the developing roller 23 and its surface moves in the same direction as the surface of the developing roller 23 at the pressed region. In another example, the liquid developer providing roller 28 is spaced apart from the developing roller 23 and electrified so as electropheretically to press the toner particles to the developing roller 23.

The liquid developer container 24 shown in FIG. 2 is one example of how to contain the liquid developer 4, and how to hold developing roller 23 and the liquid developer providing roller 28 and provide an opening at the developing region.

The developing unit may include squeeze roller 25 to reduce the solvent from the latent image retaining body 1.

The latent image retaining body 1 rotates in a direction shown by the arrow A in FIG. 1. The relative rotating direction of the latent image retaining body 1 and the developing roller 23 may be described in terms of the relative direction of the surfaces' movement at the developing region.

The surface of the developing roller 23 shown in FIG. 2 moves in the same direction as (the positive direction to) the surface movement of the latent image retaining body 1 at the developing region. The surface of the squeeze roller 25 shown in FIG. 2 moves in the reverse direction to (the negative direction to) the surface movement of the latent image retaining body 1 at a squeezing region where the squeeze roller 25 faces the latent image retaining body 1.

The relative movement between the latent image retaining body 1 and the developing roller 23, between the latent image retaining body 1 and the squeeze roller 25, and the latent image retaining body 1 and the intermediate transfer roller 7-1 may alternatively be chosen between positive or negative.

The squeeze roller 25 may include a stainless surface. The stainless surface may be spaced apart from the surface of the latent image retaining body 1 with a squeezing gap from about 20 micrometers to about 100 micrometers. The squeeze roller 25 may also include an elastic surface made of rubber or sponge and the elastic surface may be in contact with the surface of the latent image retaining body 1.

External diameters of the developing roller 23 and the squeeze roller 25 may range from about 10 millimeters to about 50 millimeters. External diameters less than about 10 millimeters may result in developing and squeezing times shorter than needed. External diameters greater than about 50 millimeters may result in a large-sized developing engine.

The developing unit 5 shown in FIG. 2 includes packing element 26 between the developing roller 23 and the squeeze roller 25 and packing element 27 between the developing roller 23 and the container 24. The packing elements 26 and 27 are supported in positions along solid lines shown in FIG. 2 during development operation and are moved into positions along broken lines shown in FIG. 2 while the operation is stopped. The packing elements 26 and 27 are examples of how to seal the liquid developer inside the developing unit 5.

A mono-color image can be obtained by using one of the developing units 5-1, 5-2, 5-3, and 5-4, or by providing the inner case 9 with only one mono-color developing unit 5. Multi-color images can be obtained by using one or two of the developing units 5-1, 5-2, 5-3, and 5-4.

Four processes are employed to form the multi color image. In a first process, a region of the latent image retaining body 1, which supports the developed image of the first color image on its surface, passes to the first transfer station, without image transfer at the first transfer station and continuously rotates to move the region to the charging region. In the case where a pressure transfer is to be employed between the latent image retaining body 1 and the intermediate transfer roller 7-1, the latent image retaining body 1 is first separated from the intermediate transfer roller 7-1 so that the first color image on the latent image retaining body 1 is not transferred. Likewise, if the first transfer is operated by electrophoresis, the latent image retaining body 1 is separated from the intermediate transfer roller 7-1 and/or an electrical potential difference is not formed between the surfaces of the latent image retaining body 1 and the intermediate transfer roller 7-1 upon development of the first color image.

After passing the transfer roller 7-1, the region supporting the first color image is then charged by the charging unit 2 and receives a second modulated light beam 3. The second modulated light beam 3 has image information for the second color whereby the region supporting the first developing image receives second latent image for the second color.

The region of the latent image retaining body 1 is then moved to a second developing region where the second developing unit 5-2 faces the latent image retaining body 1, and receives the second liquid developer from the second developing unit 5-2, so that the second color image is formed on the part of the latent image retaining body 1.

The charging, the exposure and the development for respective third and fourth colors are operated in similar process referring to the second color, therefore the multi-color image can be obtained on the latent image retaining body 1.

The first through fourth liquid developers may be yellow, magenta, cyan, and black to obtain good multi-color image. The region, supporting the multi-color image, of the latent image retaining body 1 is moved to a solvent reducing region, where the region of the latent image retaining body 1 faces the solvent reducing unit 6. As discussed hereinafter, the solvent reducing unit 6 removes the surplus solvent on the latent image retaining body 1. The region, supporting the solvent reduced image, of the latent image retaining body 1 moves to the first transfer station and the multi-color image is transferred to the final substrate, for example the paper 8, via the intermediate transfer roller 7-1.

In a second process, each single color image is developed on the latent image retaining body 1 and transferred to the intermediate transfer roller 7-1 each time before a succeeding image is developed and transferred, and each succeeding single color image is piled, in registration, on a preceding image on the intermediate transfer roller 7-1.

In a third process, transparent windows are provided between the developing units 5-1, 5-2, 5-3 and 5-4 for successive exposures by respective charging units and development of images of respective colors in series, so that the four-color images are successively formed, in registration, on the latent image retaining body 1 during one round of the latent image retaining body 1 and transferred in one step to the intermediate transfer roller 7-1.

Several transfer techniques, such as electrophoresis transfer, pressure transfer, shearing stress transfer, heating transfer, and a combination of two or more of the transfer techniques may be employed at the first transfer station. The pressure transfer and the shearing stress transfer may be employed in one embodiment to obtain higher image quality.

To transfer the image by shearing stress, the surface of the latent image retaining body contacts the intermediate transfer roller at the first transfer station and moves in a speed different from that of the intermediate transfer roller at the first transfer station. The image, which is on the surface of the latent image retaining body and moved to the transfer station, receives the shearing stress in a direction parallel to the contacting surfaces of the first transfer station and is transferred to the intermediate transfer roller. The surface speed of the intermediate transfer roller may be higher or lower than that of the latent image retaining body.

The speed difference may be in the following expression, where VI is the surface speed of the latent image retaining body and V2 is the surface speed of the intermediate transfer roller.

$$0.8<V2/V1<0.99 \text{ or } 1.01<V2/V1<1.2$$

Examples of the shearing stress transfer are disclosed in U.S. patent application Ser. No. 09/662,829 and Japanese Patent Application Publication (laid open) No. P2000347520.

To transfer the image by electrophoresis, an electrical potential difference is provided between the surfaces of the latent image retaining body 1 and the intermediate transfer roller 7-1. Several power sources are provided and coupled to the respective surfaces to provide the electrical potential difference.

The latent image retaining body 1 and the intermediate transfer roller 7-1 may have respective thin metal layers disposed on the respective surfaces or disposed adjacent to at most surfaces. The thin metal layers are coupled to respective power sources at one edge in shaft-length directions.

One example of a pressure transfer structure for transferring the images uses a supporting member, which supports edges of both shaft of the latent image retaining body 1 and the intermediate transfer roller 7-1 to provide pressure at their nip region. Both shafts of the latent image retaining body 1 and the intermediate transfer roller 7-1 may be supported to provide a total amount of weight, which may range from about 10 kilograms to about 120 kilograms.

The structure for heating the image employs a halogen lamp, which extends in a direction of the shaft-length direction and is inserted inside the shaft of the intermediate transfer roller 7-1. An appropriate power of the halogen lamp may be applied to heat the surface of the intermediate transfer roller 7-1 and the image on the roller 7-1 up to 120° C. The power is determined in consideration of the heat capacitance between the outer and inner surfaces of the intermediate transfer roller 7-1. The surface temperature of the intermediate transfer roller 7-1 may range from about room temperature to 120° C.

The heat source positioned between the solvent reducing unit 6 and the intermediate transfer roller 7-1 and facing to the latent image retaining body 1 is one example of how to heat the image on the latent image retaining body 1 prior to the first transfer station. Various other structures, which are known in the art and realize electrophoresis transfer, pressure transfer, shearing stress transfer, and/or heat transfer, may also be employed.

The intermediate transfer roller 7-1 may be removed from the transfer unit 7 and the image on the latent image retaining body 1 may be directly transferred to the paper receptor 8. Without the intermediate transfer roller 7-1, the back-up roller 7-2 is disposed adjacent to the latent image retaining body 1 and sandwiches the paper receptor 8 with the latent image retaining body 1. The intermediate transfer roller 7-1 may be employed in one embodiment of apparatus forming the image on various final substrates.

Pressure and heat may be used to implement appropriate image transfer from the intermediate transfer roller 7-1 to the paper receptor 8 at the second transfer station. The total weight from the back-up roller 7-2 to the intermediate transfer roller 7-1 may range from about 10 kilograms to about 120 kilograms. The structure to provide the weight between the latent image retaining body 1 and the intermediate transfer roller 7-1 may also be applied to provide the weight between the intermediate transfer roller 7-1 and the back-up roller 7-2, or alternative structures known in the art may also be used.

The structure to heat the image on the outer surface of the intermediate transfer roller 7-1, such as a halogen heater facing to outer surface of the intermediate transfer roller 7-1 and disposed between the back-up roller 7-2 and the latent image retaining body 1, may also be used in one embodiment. A heater disposed adjacent to and facing the outer surface of the back-up roller 7-2, and heating the back-up roller 7-2 may also be used to heat the image at the second transfer station. The surface temperature of the back-up roller 7-2 may be heated up to about 120° C. or be kept as room temperature. If it is necessary to keep those surface temperatures at the room temperature, a cooler may be used and disposed adjacent to each surface.

Figure 3:
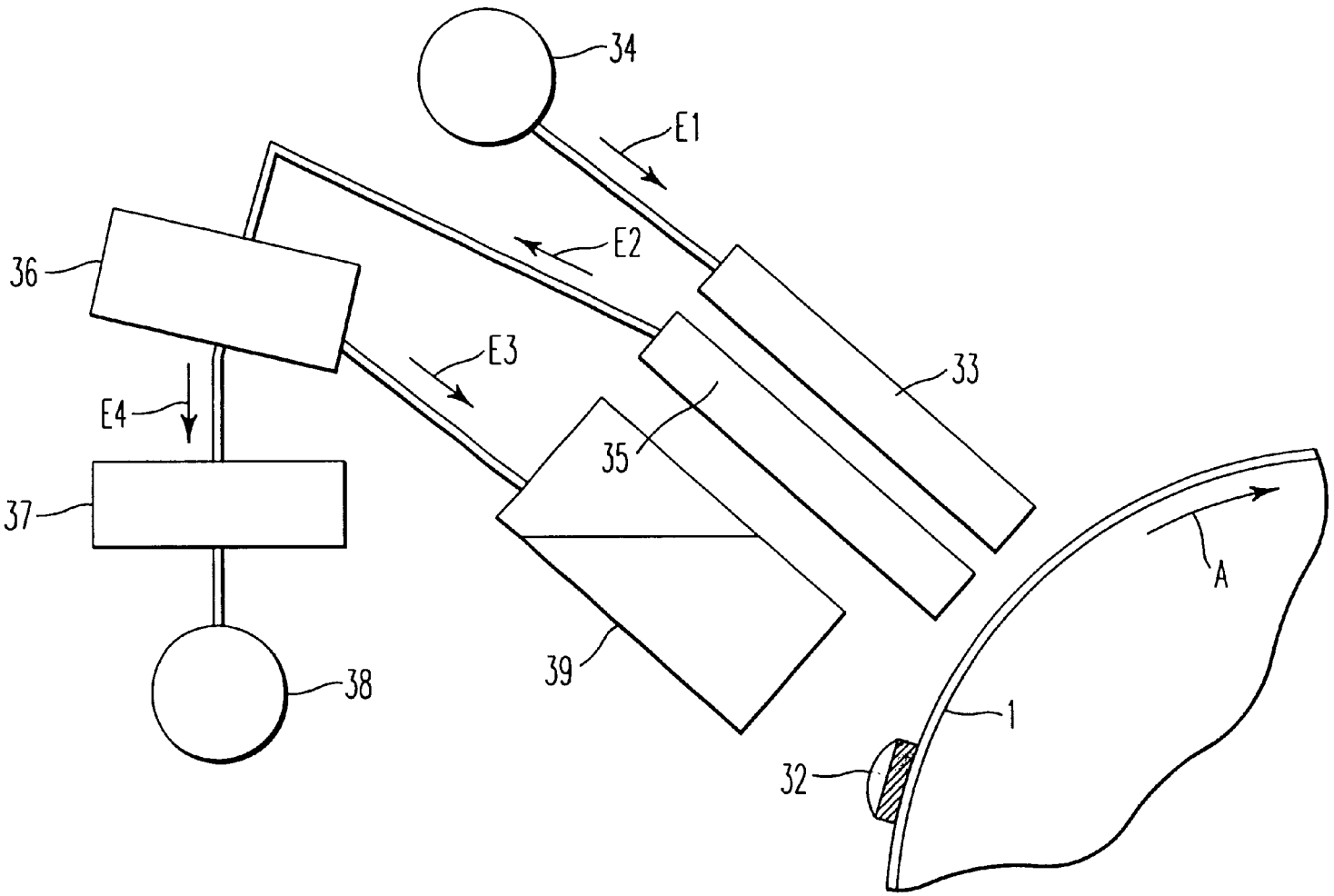
FIG. 3 is a cross-sectional view of a first example of a liquid reducing unit.

FIG. 3 is a cross-sectional view showing a first example of the solvent reducing unit 6. In this example, the solvent reducing unit includes a spray nozzle 33, an air current generating unit 34, a suction nozzle 35, a solvent liquefaction unit 36, a filter 37, a fan 38, a solvent container 39, and tubes connecting those components.

The spray nozzle 33 is one example of how to spray air to the surface of the latent image retaining body 1, which supports a developed image 32 on its outer surface. The spray nozzle 33 has one or more openings facing the latent image retaining body 1. An air current generating unit 34 is coupled to the spray nozzle 33 by a tube and is one example of how to generate and provide an air current to the spray nozzle 33. The air current generating unit 34 may be a fan.

The suction nozzle 35 is disposed adjacent to the spray nozzle 33 and includes one or more openings facing the latent image retaining body 1. The solvent liquefaction unit 36 liquefies the vapor of solvent in the suctioned air and is coupled to the suction nozzle 35 by a tube. The solvent liquefaction unit 36 may include a cooling device, for example one or more air-cooling fan(s) and/or piezoelectric device(s). The filter 37 is coupled to the solvent liquefaction unit 36 via a tube and filters residual solvent in the suctioned air. The filter 37 may include an activated carbon which absorbs the evaporated solvent efficiently, or alternative absorbent materials. The fan 38 is coupled to the filter 37 by a tube and is one example of how to suck the air current. The fan 38 may be employed with a pump, or a pump may be employed instead of the fan 38. The container 39 is coupled to the solvent liquefaction unit 36 by the tube and receives and stores liquefied solvent.

The arrows E1, E2, E3, and E4 in FIG. 3 show fluid flow directions. The developed image 32 on the latent image retaining body 1 has a solid portion, which is the hatched lump in FIG. 3, and a liquid solvent on the solid portion. The air current generating unit 34 provides the air current to the spray nozzle 33, which provides the air current to the image 32 on the latent image retaining body 1, thereby promoting the evaporation of the solvent on the latent image retaining body 1. The air current generating unit 34 may contain a heat generator and the air current produced at the unit 34 may have an average temperature ranging from about room temperature to about 150° C. Alternative structures known in the art for the air current producing unit 34 and the heat generator may be used in the embodiments of the present invention.

The suction nozzle 35 and the filter 37 in FIG. 3 may be coupled directly with the tube.

The container 39 may be coupled to the developing units 5-1, 5-2, 5-3, and 5-4 via a tube and the collected solvent in the container 39 may be poured into the container 24 in FIG. 2 and be used again for development. The solvent kept in the container 39 may also be disposed of.

The unit shown in FIG. 3 and including the suction nozzle 35, the solvent liquefaction unit 36, the filter 37, the fan 38, a motor or pump, and the container 39 is one example of how to collect the solvent.

Figure 4:
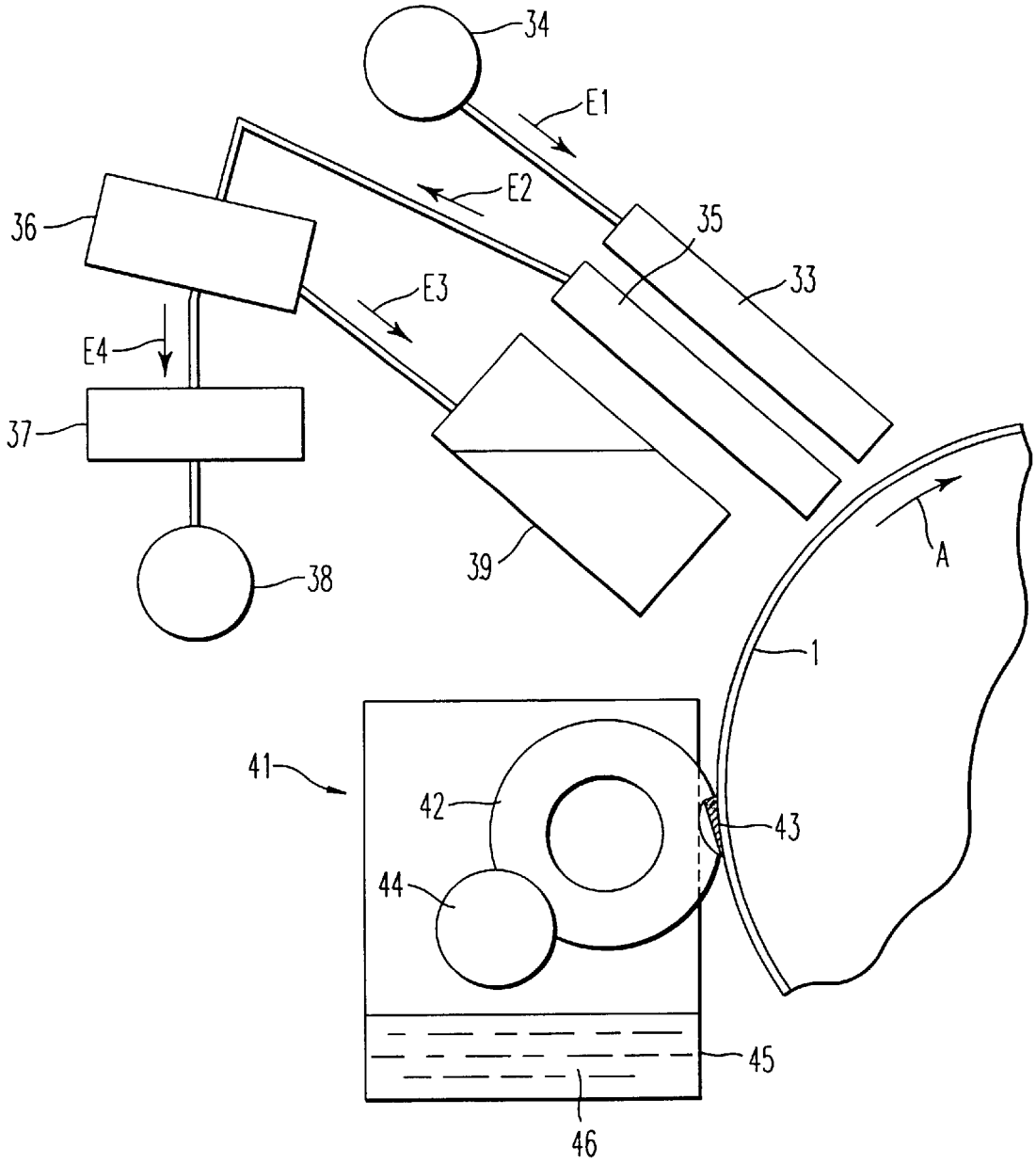
FIG. 4 is a cross-sectional view of a second example of the liquid reducing unit.

FIG. 4 is a cross-sectional view showing a second example of the solvent reducing unit 6. In FIG. 4, a solvent absorption unit 41 is arranged adjacent to the latent image retaining body 1 and solvent on the latent image retaining body 1 is absorbed and reduced before receiving the air spray. The solvent absorption unit 41, one example of how to absorb the solvent on the latent image retaining body 1, has an absorption roller 42, which may have a liquid absorption material, for example, styrene foam or a non-woven fabric. A nozzle, which absorbs the solvent by utilizing suction pressure, may be disposed in place of the roller 42.

The absorption roller 42 or the nozzle has a surface facing the latent image retaining body 1. The surface may include a conductive material and receive a certain electrical potential of the same polarity as that of the charge of toner particles, so that the surface may repel the toner particles and press them against the latent image retaining body 1 so that the image on the latent image retaining body 1 may not receive much damage.

Another roller 44 may be used to remove the solvent from the absorption roller 42. The roller 44 may be pressed against the absorption roller 42. Negative air pressure may also be applied inside or outer surface of the absorption roller 42 so as to vacuum the solvent from the absorption roller 42. The removed solvent 46 may be contained in a container 45 leaving the developed image 43 on the outer surface of body 1.

The solvent absorption unit 6 in FIG. 1 is disposed inside of the inner case 9, otherwise, the solvent absorption unit 6 may be separated into two or more sections and some of the sections may be disposed outside of the inner case 9 and coupled with other sections disposed inside of the inner case 9 though a joint at the inner case 9. For example, the spray nozzle 33 and the suction nozzle 35 may be arranged in the inner case 9, and the motor and the pump may be arranged outside of the inner case 9 but in the outer case 12. Thus, when only the inner case 9 and its contents are required to be exchanged periodically, both low cost and energy saving are realized.

The containers 39 and 45 may be set up in the inner case 9 so that the collected solvent can be disposed of with the inner case 9. The containers 39 and 45 may be set up outside of the inner case 9 so that the users may dispose of the solvent in the containers 39 and 45 independently.

Figure 5:
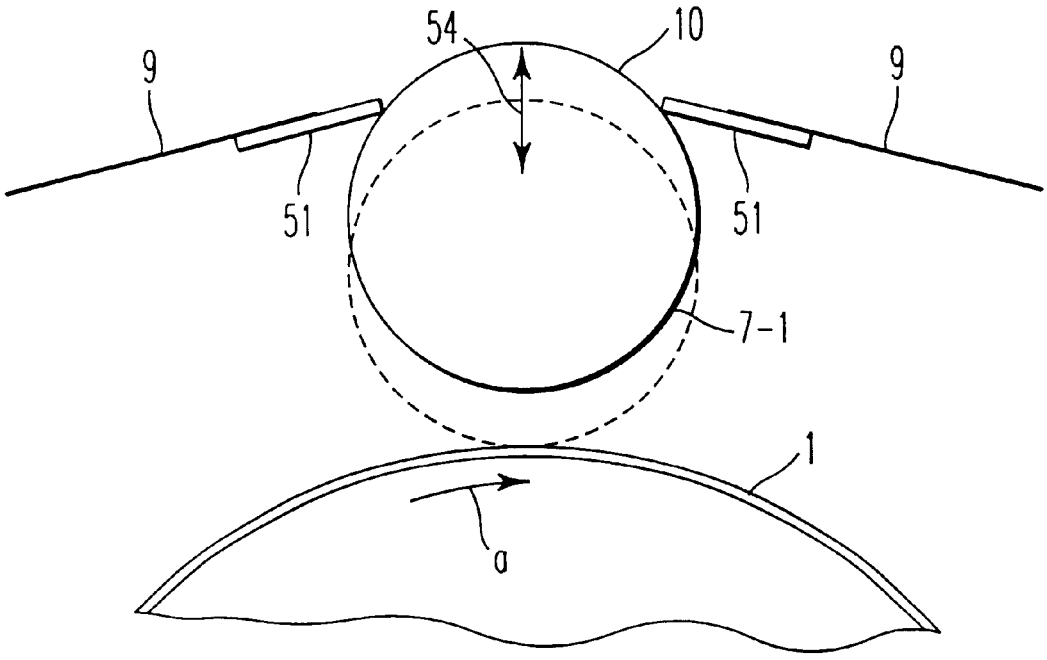
FIG. 5 is a cross-sectional view of a sealing section of an inner case according to the first embodiment of the present invention.

FIG. 5 is a cross-sectional view showing one example of the sealing section attached to the frame of the inner case 9.

The intermediate transfer roller 7-1 is supported by supporting members via the shaft of the intermediate transfer roller 7-1 and moves along the arrows 54 shown in FIG. 5. The circle drawn by straight line shows the position of the intermediate transfer roller 7-1, when it is apart from the latent image retaining body 1 during the formation of the multi-color image on the latent image retaining body 1 and transfer at the first transfer station is not performed, and the circle drawn by broken line shows another position of the intermediate transfer roller 7-1, when it contacts the latent image retaining body 1 during the transfer of the image at the first transfer station.

When the intermediate transfer roller 7-1 is not in operation, the intermediate transfer roller 7-1 contacts the packing elements 51, which are fixed to both end regions abutting to opening 10 of the frame of the inner case 9, and the opening 10 is sealed by the intermediate transfer roller 7-1 and the packing elements 51. The packing elements 51 may have rectangular shape extending parallel to the opening and perpendicular to the cross-sectional view of FIG. 5.

A cover, which automatically shuts and seals the opening 10 when the transfer at the second transfer station is not in process, may also be employed to seal the opening. The both structures also seal the opening 10 when the inner case 9 is detached from the outer case 12.

Both sections disposed inside and outside of the inner case 9 of the solvent reducing unit 6 must be coupled through a joint in the inner case 9. The joint should seal the joint opening when the inner case 9 is detached from the outer case 12. Various structures of the joints, which are well known in the art, may be used.

When the inner case 9 is detached from the outer case 12, the packing elements 26 and 27 shown in FIG. 2 may seal the openings of the developing unit 5 so as to prevent leakage of the liquid developer 4 or its solvent from the development unit 5. An additional container, which is attached to the outside of the inner case 9 and coupled to the container 24 of the development unit 5 by a joint, may be used. The joint seals opening of the container 24, when the inner case and the container 24 are detached from the outer case 12.

When the developing process is stopped, the liquid developer 4 in the container 24 held by the inner case 9 may be drawn from the container 24 to the additional container so that the leakage of the liquid developer from the inner case 9 is prevented. To draw the liquid developer 4, a small opening of the container 24 and a tube coupled to the opening of the container 24 may be used. A pump or motor can also be used to draw the liquid developer 4. The liquid developer in the additional container may be disposed of with the additional container and exchanged with new liquid developer in a new container, or additional liquid developer may be added to the container, whereby maintenance of the liquid developer can be decreased.

The inner case 9 may be permanently fixed to the outer case 12, and when development is in operation, there must be the openings in the inner case 9 for the operation and the solvent reducing unit 6 to operate to reduce the amount of leakage of the solvent to outside of the inner case 9. The inner case 9 fixed to the outer case 12 requires that the additional liquid developer 4 may be supplied through a tube from a container disposed outside of the inner case 9 to the container 24. The container disposed outside of the inner case 9 may be changed with new container, which is full of a new liquid developer.

In this embodiment, the development unit 5, the solvent reducing unit 6, and the intermediate transfer roller 7-1 are held by the inner case 9 so as to reduce the leakage of the solvent and its vapor, and therefore, the image forming apparatus is appropriate for use in office and home. The image forming apparatus using the inner case 9 also realizes a small-sized, low cost product, and yet can obtain high texture image at higher speed.

Figure 6:
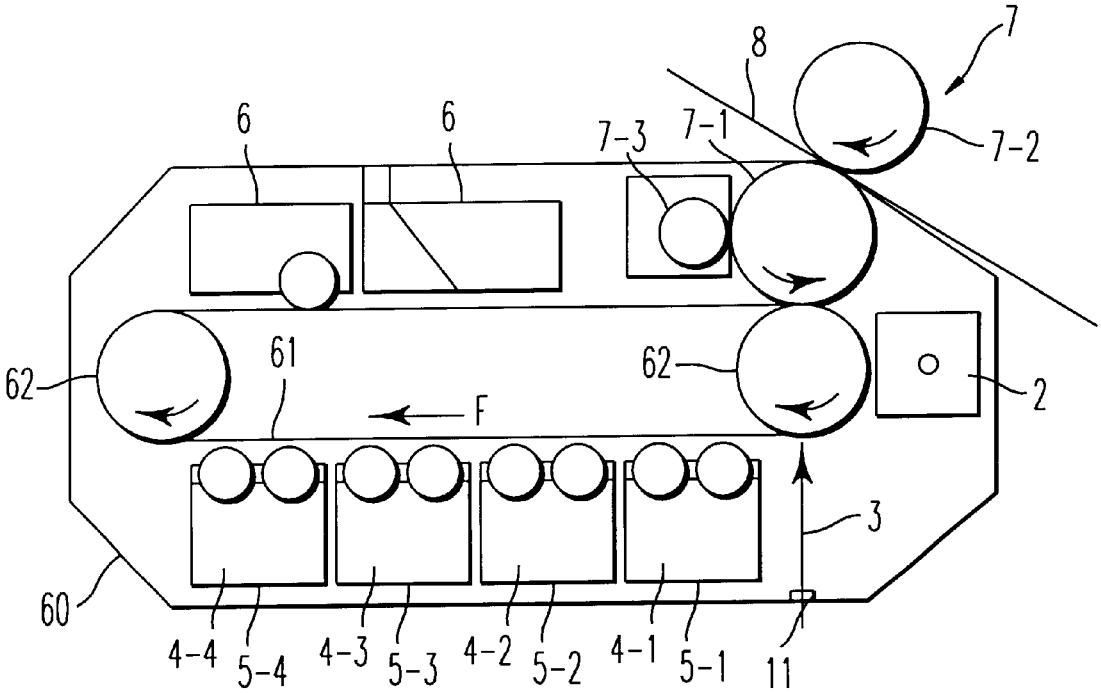
FIG. 6 is a cross-sectional view of an image forming apparatus according to a second embodiment of the present invention.

FIG. 6 shows a cross-sectional view showing an image developing system according to a second embodiment of the present invention, including a photosensitive belt 61 as the latent image retaining body 1 and an inner case 60 in place of the inner case 9.

The inner case 60 shown in FIG. 6 contains the photosensitive belt 61, a pair of driving roller 62, and can be attached to and detached from the outer case 12, therefore the system according the second embodiment can also obtain similar effect to the first embodiment. The photosensitive belt 61 is one example of the latent image retaining body 1 and the belt 61 rotates in a direction along the arrow F shown in FIG. 6 by rotations of the pair of driving roller 61.

The development units 5-1, 5-2, 5-3, and 5-4 are arranged in a row at the bottom of the flat inner case 60, therefore, even though shapes and structures of the development units 5-1, 5-2, 5-3, and 5-4 are uniform, the leakage of the liquid developer can be reduce. This feature is appropriate in regard to mass production and a reduction of dead space. The photosensitive belt 61 may comprise a flexible organic photosensitive belt or other equivalent belt known in the art.

Figure 7:
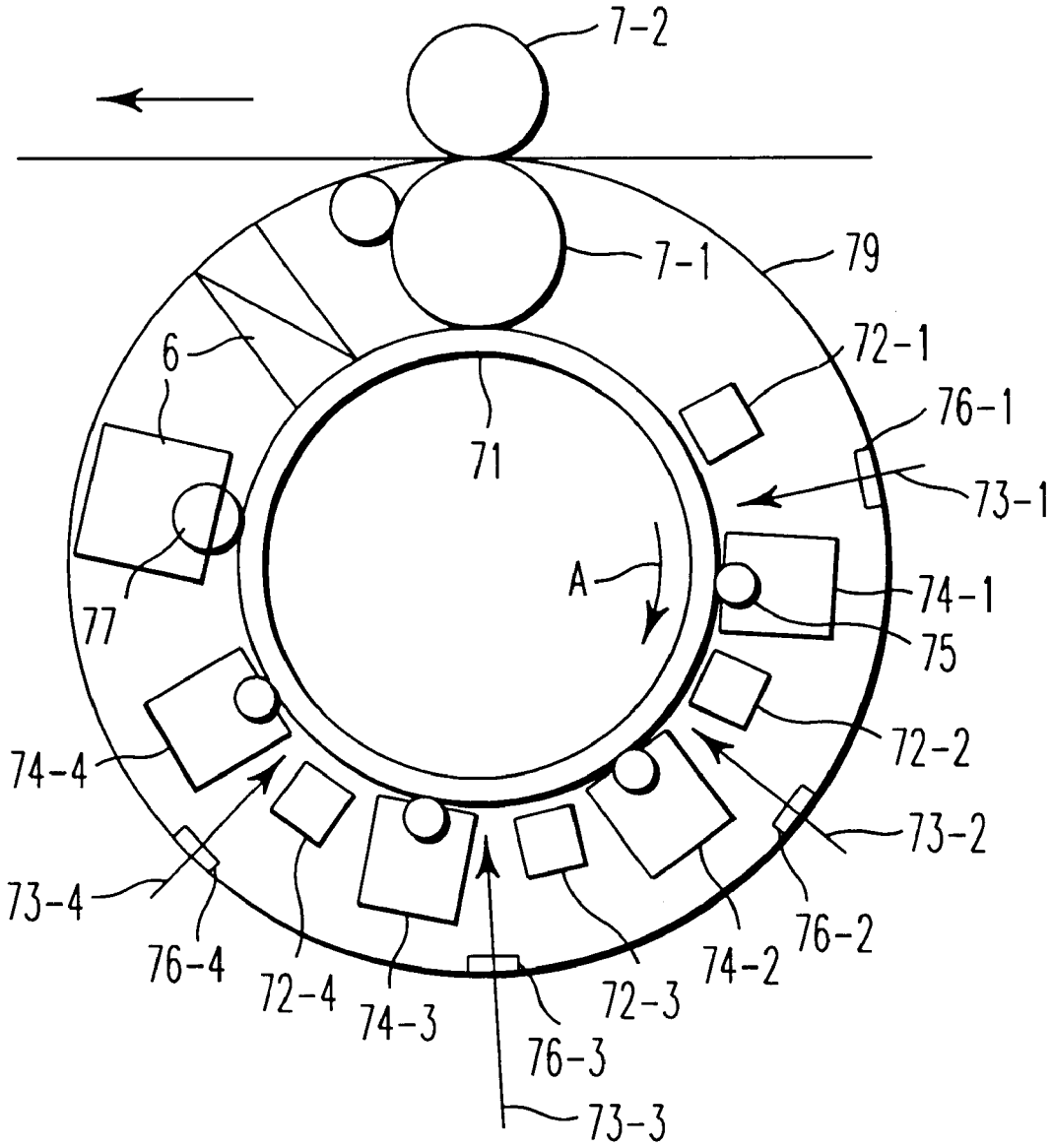
FIG. 7 is a cross-sectional view of an image forming apparatus according to a third embodiment of the present invention.

FIG. 7 is a cross-sectional view showing an image developing system according to the third embodiment of the present invention.

The image developing system comprises an inner case 79, which contains a latent image retaining body 71, four charging units 72-1, 72-2, 72-3, and 72-4, four transparent windows 76-1, 76-2, 76-3, and 76-4, four development units 74-1, 74-2, 74-3, and 74-4, the solvent reducing unit 77, and the intermediate transfer roller 7-1. A back-up roller 7-2 is disposed adjacent to the intermediate transfer roller 7-1. The first charging unit 72-1, the first transparent window 76-1, and the first development unit 74-1 are a first set to develop a first color on the latent image retaining body 71. The second charging unit 72-2, the second transparent window 76-1, and the second development unit 74-2 are arranged next to the first set and as the rotation of the latent image retaining body 71 proceeds, below the first set. A third set, for the third color liquid development, namely the charging unit 72-3, the transparent window 76-3, and the development unit 74-3, and a fourth set for the fourth color development, namely the charging unit 72-4, the transparent window 76-4, and the development unit 74-4 are successively arranged around the latent image retaining body 71 along the rotation of the latent image retaining body 71. The transparent windows 76-1, 76-2, 76-3, and 76-4 are attached to the inner case 79 and arranged to pass transparent modulated light beams 73-1, 73-2, 73-3, and 73-4. A multicolor image is developed on the latent image retaining body 71 during one rotation of the latent image retaining body 71.

The third embodiment also uses the inner case 79, which can be attached to and detached from the outer case 12 or be fixed to the outer case 12 permanently and has same benefit described in the first embodiment.

Each of development units 74-1, 74-2, 74-3, or 74-4 in FIG. 7 has a developing roller 75, but doesn't have a squeeze roller adjacent to the developing roller 75. Instead of using the squeeze roller, the developing roller 75 may have an elastic surface, for example, a urethane foam surface, so that the roller 75 provides the liquid developer to the surface of the latent image retaining body 71 and also removes excess liquid from the surface of the latent image retaining body 71.

Figure 8:
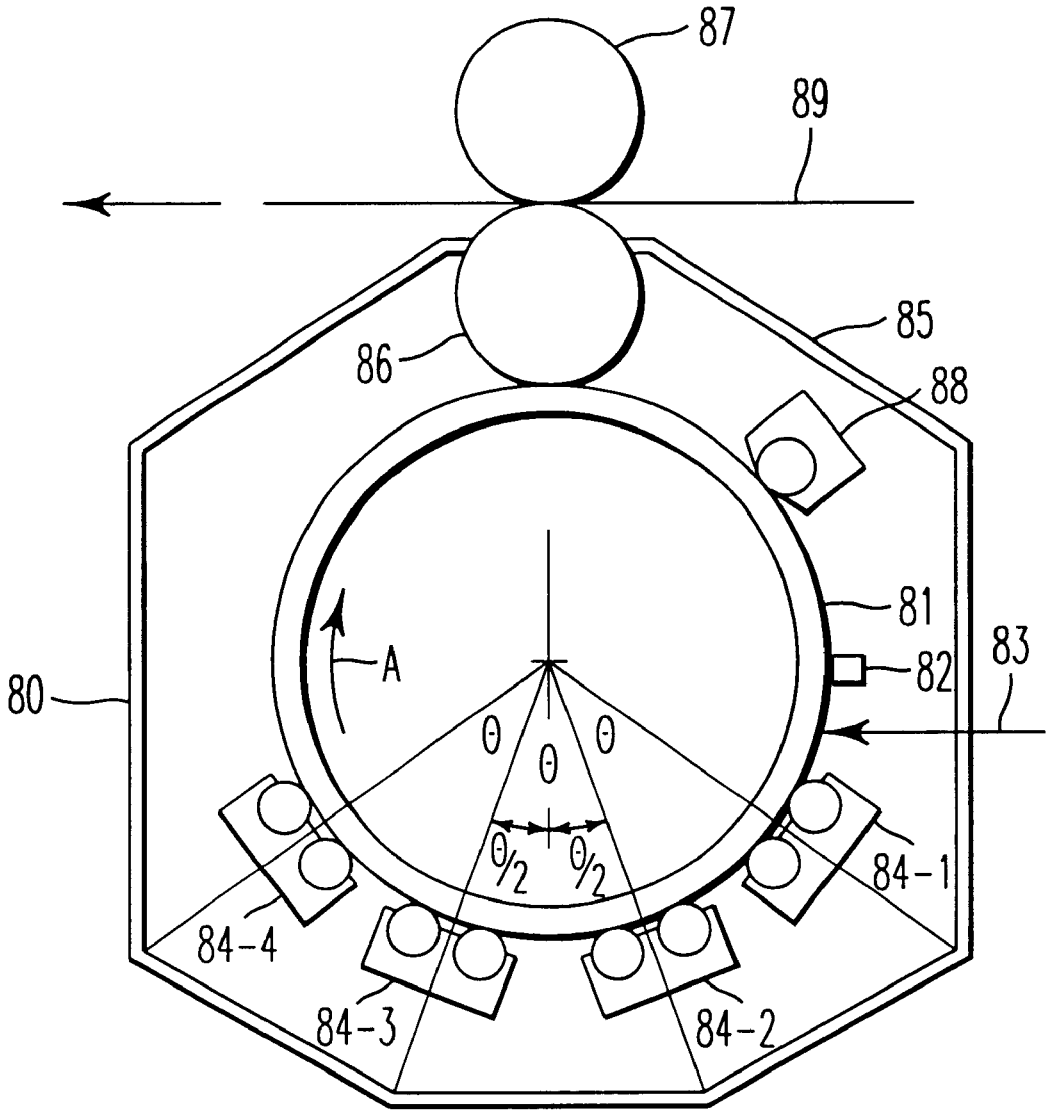
FIG. 8 is a cross-sectional view of an image forming apparatus according to a fourth embodiment of the present invention.

FIG. 8 is a cross-sectional view showing an image developing system according to a fourth embodiment of the present invention.

This developing system includes an inner case 80, which is fixed to, or can be attached to and detached from, the outer case 12 shown in FIG. 1 in same manner as described in the above embodiments.

A latent image retaining body 81 is held at the inside center of the inner case 80, and extends in a same direction perpendicular to the cross-sectional view shown in FIG. 8. A cleaner 88, a charging unit 82, four developing units 84-1, 84-2, 84-3, and 84-4, and an intermediate transfer roller 86 surround the latent image retaining body 81. The inner case 80 has an opening at the second transfer station where the intermediate transfer roller faces a back-up roller 87, but the opening may be sealed by the intermediate transfer roller 86 that contacts the edge of the opening of the inner case 80 when the intermediate transfer roller 86 is not in operation. A modulated light beam 83 is applied to the charged latent image retaining body 81 through a transparent window.

The latent image retaining body 81 receives pressure from the intermediate transfer roller 86, and the four developing units 84-1, 84-2, 84-3, and 84-4. Weight of pressure from the intermediate transfer roller is arranged to be substantially equal to the total weight of pressures from the four developing units 84-1, 84-2, 84-3, and 84-4. The directions of the pressures applied from the intermediate transfer roller 86 and from the four developing units 84-1, 84-2, 84-3, and 84-4 are substantially anti-parallel so that they cancel out each other. Therefore a shaft of the latent image retaining body 81 has a low friction load, and both smooth rotation of the latent image retaining body 81 and high image quality can be obtained for a long time period.

The reduction of the friction rate also allows use of a thinner frame body for the inner case 80, which supports the shaft of the latent image retaining body 81, so that a very light body can be obtained.

Wherein the present invention has been particularly shown and described with reference to preferred embodiments thereof, it will be understood by those skilled in the art that various other changes in the form and details may be made therein without departing from the spirit and scope of the invention.

What is new and desired to be secured by Letters Patent of the United States is:

1. An image forming apparatus which forms an image on a substrate using a liquid developer containing toner particles and a solvent, comprising:

a latent image retaining body comprising a photosensitive layer;

a developing unit disposed adjacent to the latent image forming unit and facing the latent image retaining body, the developing unit configured to provide the liquid developer on the image retaining body;

a solvent reducing unit disposed adjacent to the developing unit and facing the latent image retaining body, the solvent reducing unit configured to reduce the solvent of the liquid developer on the latent image retaining body;

a transfer unit disposed adjacent to the latent image retaining body and the solvent reducing unit; and an inner case comprising a frame having an opening, the inner case supporting the latent image retaining body, the developing unit, and the solvent reducing unit inside of the frame, and the opening being arranged adjacent to the transfer unit.

2. The apparatus of claim 1, further comprising:

an outer case housing the inner casing and detachably supporting the inner case; and a sealing section attached to the frame and abutting a portion of the inner casing defining the opening.

3. The apparatus of claim 1, comprising a plurality of the developing units.

4. The apparatus of claim 1, wherein the transfer unit comprises:

an intermediate transfer surface and a back-up body, the intermediate transfer surface facing the latent image retaining body at a first transfer station, the back-up surface facing the latent image retaining body at a second transfer station, and the intermediate transfer surface disposed inside of the inner case.

5. The apparatus of claim 1, further comprising:

a charging unit disposed inside of the inner case; and a transparent surface fixed to the inner case adjacent to the charging unit and the developing unit.

6. An image forming apparatus which forms an image on a substrate using a liquid developer containing toner particles and a solvent, comprising:

means for retaining a latent image;

means for developing the latent image by providing the liquid developer on the means for retaining;

means for reducing the solvent the latent image after development by the means for developing;

means for transferring a solvent-reduced developed image from the means for retaining to the substrate; and means for casing the means for retaining, the means for developing, and the means for reducing, the means for casing comprising an opening adjacent to the means for transferring.

7. The apparatus of claim 6, further comprising:

an outer case and means for sealing the opening, wherein the means for casing can be attached to and detached from the outer case.

8. The apparatus of claim 6, further comprising:

a plurality of the means for developing, each developing an image of a color different from each other.

9. The apparatus of claim 6, wherein the transfer means comprises:

first means held by the means for casing, for receiving the image from the means for retaining; and second means for receiving the image from the first means for receiving.

10. The apparatus for forming the image of claim 6, further comprising:

means held inside of the means for casing for charging the means for retaining; and means fixed to the means for casing for letting a light beam pass.

11. A developing system for attachment to an image forming apparatus and development of an image by using a liquid developer containing toner particles and a solvent, comprising:

a latent image retaining body comprising a photosensitive layer;

a developing unit facing the latent image retaining body and configured to provide the liquid developer on the image retaining body;

a solvent reducing unit facing the latent image retaining body and disposed adjacent to the developing unit, the solvent reducing unit configured to reduce the solvent of the liquid developer on the latent image retaining body; and an inner case comprising a frame having an opening, the inner case supporting the latent image retaining body, the developing unit, and the solvent reducing unit inside of the frame, and the opening being arranged adjacent to the solvent reducing unit.

12. The developing system of claim 11, further comprising:

an intermediate transfer surface configured to rotate in a fixed track, wherein a first part of the fixed track is disposed inside of the inner case and a second part of the fixed track is disposed adjacent to the opening.

13. A developing system for attachment to an image forming apparatus and development of an image by using a liquid developer containing toner particles and a solvent, comprising:

means for retaining a latent image;

means for developing the latent image using the liquid developer;

means for reducing the solvent from the latent image developed by the means for developing; and means for casing the means for retaining, the means for developing, and the means for reducing, the means for casing comprising an opening adjacent to the means for reducing the solvent.

* * * * *